US007762846B1

(12) United States Patent
Whiteman, Jr. et al.

(10) Patent No.: US 7,762,846 B1
(45) Date of Patent: Jul. 27, 2010

(54) CONNECTOR ASSEMBLY HAVING A BACK SHELL

(75) Inventors: Robert Neil Whiteman, Jr., Middletown, PA (US); Christopher David Ritter, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/559,716

(22) Filed: Sep. 15, 2009

(51) Int. Cl.
*H01R 13/648* (2006.01)

(52) U.S. Cl. ..... 439/607.23; 439/607.1

(58) Field of Classification Search ..... 439/607.23, 439/607.1
See application file for complete search history.

(56) References Cited

U.S. PATENT DOCUMENTS 5,090,920 A * 2/1992 Casey ..... 439/540.1
5,348,482 A * 9/1994 Rudy et al. ..... 439/61
5,387,130 A * 2/1995 Fedder et al. ..... 439/607.47
5,480,326 A * 1/1996 Chen ..... 439/607.23
5,525,066 A * 6/1996 Morlion et al. ..... 439/607.05
6,036,543 A * 3/2000 Panis et al. ..... 439/607.01
6,299,483 B1 * 10/2001 Cohen et al. ..... 439/607.07
6,565,388 B1 * 5/2003 Van Woensel et al. .. 439/607.48
7,264,509 B1 * 9/2007 McAlonis et al. ..... 439/607.07
7,422,490 B2 * 9/2008 Droesbeke et al. ..... 439/701
7,503,804 B2 * 3/2009 Minich ..... 439/607.05

* cited by examiner

*Primary Examiner*—Briggitte R Hammond

(57) ABSTRACT

A connector assembly includes a housing having a front and a rear and openings in an outer periphery of the housing. Contact modules are received in the housing through the rear. The contact modules extend from the rear of the housing. The contact modules have grooves in an outer periphery of the contact modules. A back shell is coupled to the housing and the contact modules. The back shell has housing tabs extending therefrom being received in the openings of the housing to secure the back shell to the housing. The back shell also has contact module tabs extending therefrom being received in corresponding grooves of the contact modules to secure the back shell to the contact modules. The back shell peripherally surrounds the contact modules.

20 Claims, 7 Drawing Sheets

CONNECTOR ASSEMBLY HAVING A BACK SHELL

BACKGROUND OF THE INVENTION

The subject matter herein relates generally to connector assemblies, and more particularly, to a connector assembly having a housing that holds contact modules.

With the ongoing trend toward smaller, faster, and higher performance electrical components such as processors used in computers, routers, switches, etc., it has become increasingly desirable for the electrical interfaces along the electrical paths to also operate at higher frequencies and at higher densities with increased throughput. For example, performance demands for video, voice and data drive input and output speeds of connectors within such systems to increasingly faster levels.

An electrical interconnection between devices is typically made by joining together complementary electrical connectors that are attached to the devices. One application environment that uses such electrical connectors is in high speed, differential electrical systems, such as those common in the telecommunications or computing environments. In a traditional approach, two circuit boards are interconnected with one another in a backplane and a daughter board configuration. However, similar types of connectors are also being used in cable connector to board connector applications. With the cable connector to board configuration, one connector, commonly referred to as a header, is board mounted and includes a plurality of signal contacts which connect to conductive traces on the board. The other connector, commonly referred to as a cable connector or a receptacle, includes a plurality of contacts that are connected to individual wires in one or more cables of a cable assembly. The receptacle mates with the header to interconnect the board with the cables so that signals can be routed therebetween.

However, such cable connectors are not without problems. Typically the connections of the wires to the contacts are susceptible to damage and/or failure, such as due to strain on the cables. One solution to this type of problem is to provide strain relief on the cables and/or the interface of the wires with the contacts. Such solutions have heretofore proven difficult. Additionally, as the throughput speed of such cable connectors increases, the cable connectors are more susceptible to performance degradation, such as from alien cross-talk.

A need remains for a cable connector that overcomes at least some of the existing problems of damage or failure at the interconnection of the wires with the cable connector in a cost effective and reliable manner.

BRIEF DESCRIPTION OF THE INVENTION

In one embodiment, a connector assembly is provided that includes a housing having a front and a rear and openings in an outer periphery of the housing. Contact modules are received in the housing through the rear. The contact modules extend from the rear of the housing. The contact modules have grooves in an outer periphery of the contact modules. A back shell is coupled to the housing and the contact modules. The back shell has housing tabs extending therefrom being received in the openings of the housing to secure the back shell to the housing. The back shell also has contact module tabs extending therefrom being received in corresponding grooves of the contact modules to secure the back shell to the contact modules. The back shell peripherally surrounds the contact modules.

Optionally, the back shell may have an upper shell and a lower shell separate and distinct from the upper shell. The upper shell and the lower shell may be substantially identical to one another. The upper and lower shells may be hermaphroditic shell halves that are coupled to one another and to the housing and contact modules. The connector assembly may include a pair of the housings each receiving multiple contact modules, where the back shell is coupled to both housings and holds both housings together as a unit. Optionally, the back shell may be metal and provide shielding around the entire periphery of the contact modules. The upper shell and the lower shell may both have an end wall and opposite side walls extending from the end wall. The side walls may have latching features, with the latching features of the upper shell cooperating with the latching features of the lower shell to secure the upper shell and the lower shell together. At least one of the side walls of the lower shell may include a rail configured to engage a corresponding side wall of the upper shell that prevents axial movement of the upper shell with respect to the lower shell.

In another embodiment, a connector assembly is provided including one or more connectors. Each connector having a connector housing having openings in an outer periphery of the housing and contact modules received in housing. The contact modules extending rearward from the housing and having a dielectric body encasing multiple contacts. The contacts are configured to be terminated to cables extending rearward from the dielectric body. The dielectric bodies of the contact modules have grooves therein. A metal back shell is coupled to the connector and provides shielding around the connector. The back shell has an upper shell and a lower shell separate and distinct from one another. The upper shell and the lower shell are coupled to one another to peripherally surround the connector. The back shell is coupled to the housing and to the contact modules to maintain the relative positions of the contact modules with respect to the housing.

DETAILED DESCRIPTION OF THE INVENTION

Figure 1:
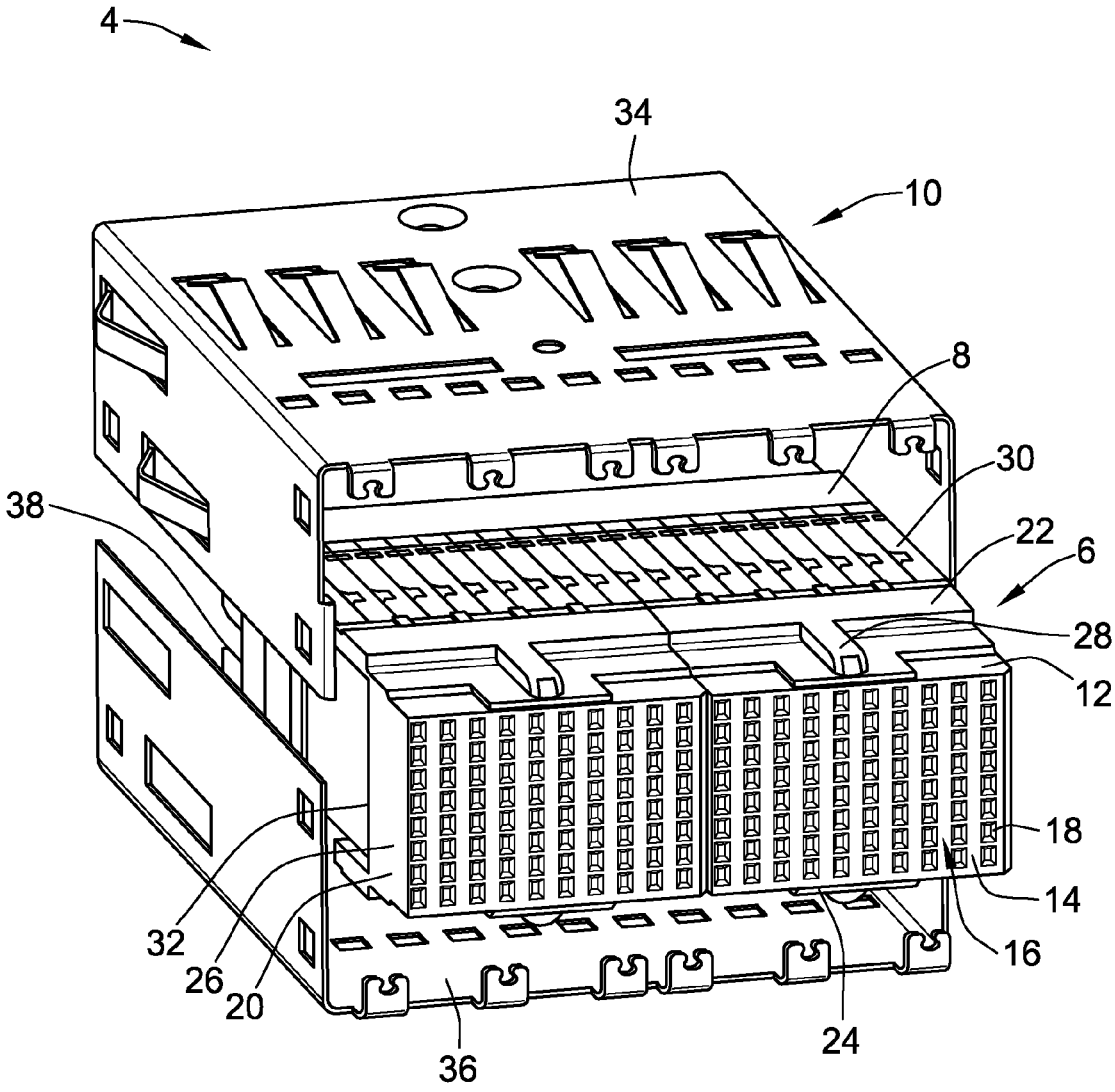
FIG. 1 is a front perspective, partially exploded view of a receptacle connector assembly formed in accordance with an exemplary embodiment.

FIG. 1 is a front perspective, partially exploded view of a receptacle connector assembly 4 formed in accordance with an exemplary embodiment. The receptacle connector assembly 4 is matable with a header connector assembly (not shown) to create a differential connector system. For example, the header connector assembly may be a Z-PACK TinMan header connector, which is commercially available from Tyco Electronics. While the receptacle connector assembly 4 will be described with particular reference to high speed, differential cable connectors, it is to be understood that the benefits herein described are also applicable to other connectors in alternative embodiments. The following description is therefore provided for purposes of illustration, rather than limitation, and is but one potential application of the subject matter herein.

As illustrated in FIG. 1, the receptacle connector assembly 4 includes a pair of cable connectors 6 and a cable exit plate 8 held together by a back shell 10. The cable connectors 6 are arranged in a stacked configuration side-by-side. The electrical connectors 6 may be stacked horizontally or vertically. Any number of cable connectors 6 may be provided within the connector assembly 4 and held by the back shell 10. In an alternative embodiment, only one cable connector 6 is provided and held by the back shell 10. The cable exit plate 8 is provided rearward of the cable connectors 6. The cable exit plate 8 holds cables that extend from the cable connectors 6. The cable exit plate 8 provides strain relief for the cables. Multiple cable exit plates 8 may be used, such as one for each cable connector 6.

The back shell 10 physically holds the cable connectors 6 and cable exit plate 8 together. The back shell 10 is manufactured from a metal material and forms a cable chamber that receives the cable exit plate 8 and the cable connectors 6. The back shell 10 provides shielding for the cable connectors 6 as well as the cable exit plate 8 and the associated cables. The back shell 10 extends entirely around the cable exit plate 8 and the cable connectors 6 to provide circumferential shielding from electrical interference, such as electromagnetic interference (EMI).

Each cable connector 6 includes a dielectric housing 12 having a front 14 that includes a mating interface 16 and a plurality of contact cavities 18. The front 14 defines a forward mating end. The contact cavities 18 are configured to receive corresponding mating contacts (not shown) from the header connector assembly. The housing 12 includes a plurality of support walls 20, including an upper shroud wall 22, a lower shroud wall 24 and side walls 26. Alignment ribs 28 are formed on the upper shroud wall 22 and lower shroud wall 24. The alignment ribs 28 cooperate to bring the cable connectors into alignment with the header connector assembly during the mating process so that the mating contacts of the mating connector are received in the contact cavities 18 without damage.

A plurality of contact modules 30 are received in each housing 12 from a rear 32 of the housing 12. The rear defines a rearward loading end. The back shell 10 is used to securely couple the contact modules 30 to the housing 12. Cables 38 are terminated to the contact modules 30 and extend rearward of the contact modules 30.

In an exemplary embodiment, the back shell 10 has two hermaphroditic shell halves that are coupled together to form the back shell 10. The shell halves are coupled together around the cable connectors 6, such as from above and below the cable connectors 6. In an exemplary embodiment, the back shell 10 includes an upper shell 34 and a lower shell 36 that are separate and distinct from one another. The upper and lower shells 34, 36 are coupled together such that the upper and lower shells 34, 36 peripherally surround the housings 12 and contact modules 30 of the cable connectors 6. The upper and lower shells 34, 36 are coupled to the housings 12 and to the contact modules 30 to maintain the relative positions of the contact modules 30 with respect to the housing 12. In an exemplary embodiment, the upper and lower shells 34, 36 are substantially identically formed. For example, the upper and lower shells 34, 36 may be manufactured as the same part in an assembly line. In an exemplary embodiment, the upper and lower shells 34, 36 are stamped and formed from a blank of metal material. During assembly, the lower shell 36 is inverted with respect to the upper shell 34 and coupled thereto.

Figure 2:
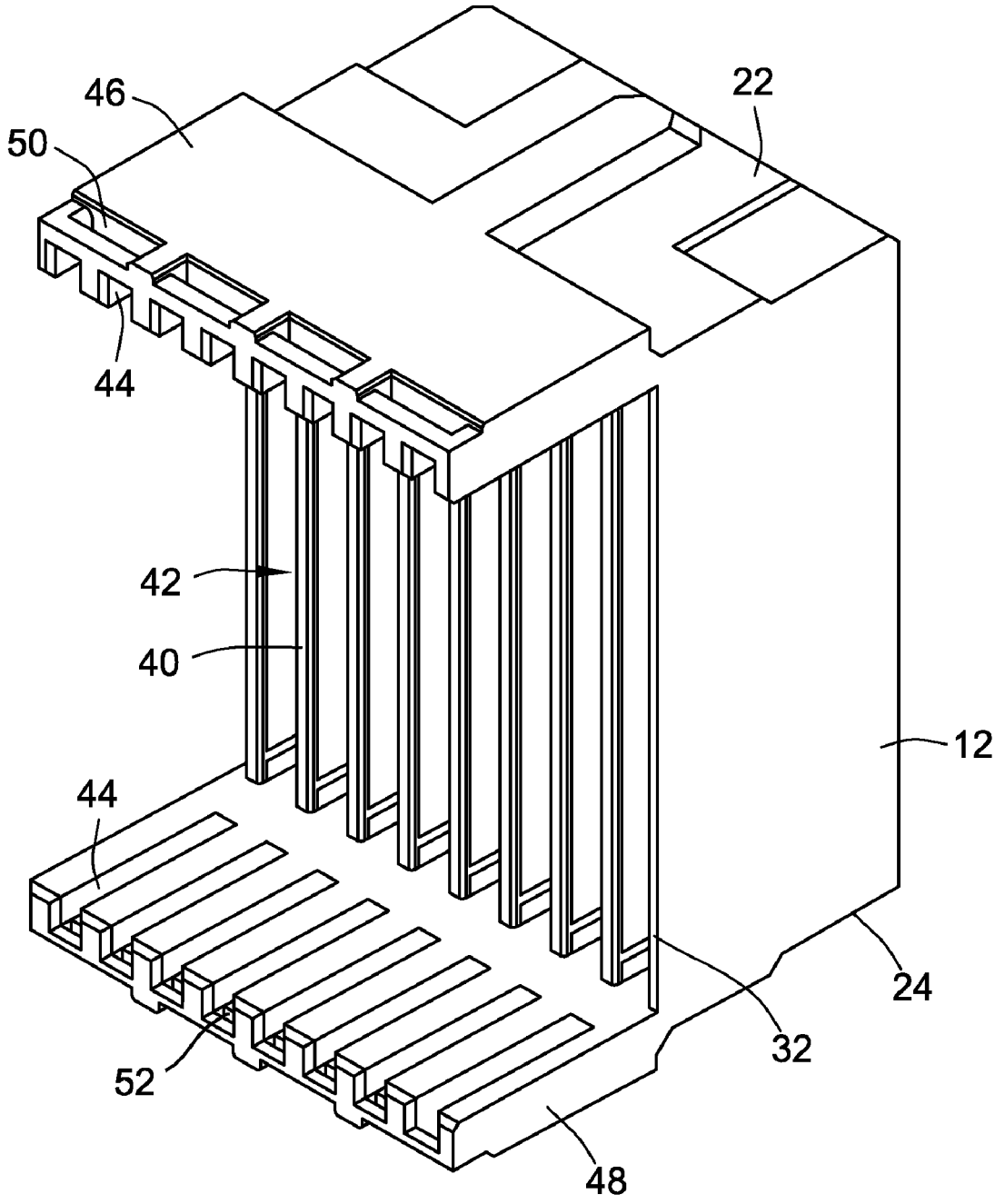
FIG. 2 is a rear perspective view of a housing for a cable connector of the receptacle connector assembly shown in FIG. 1.

FIG. 2 is a rear perspective view of the housing 12 for the electrical connector 6 (shown in FIG. 1). The housing 12 includes a plurality of dividing walls 40 that define a plurality of chambers 42. The chambers 42 receive a forward portion of the contact modules 30 (shown in FIG. 1). A plurality of slots 44 are formed in upper and lower hood portions 46, 48 that extend rearwardly from the loading end 32 of the housing 12. The hood portions 46, 48 generally form extensions of the upper and lower shroud walls 22, 24, respectively. The slots 44 may have equal width. The chambers 42 and slots 44 cooperate to stabilize the contact modules 30 when the contact modules 30 are loaded into the housing 12.

In an exemplary embodiment, openings 50, 52 are formed in the outer periphery of the housing 12, such as at the hood portions 46, 48, respectively. The openings 50, 52 are positioned proximate to a rearward end of the hood portions 46, 48. Portions of the upper and lower shells 34, 36 (shown in FIG. 1) may be received within the openings 50, 52, respectively, when the receptacle connector assembly 4 is assembled. Optionally, the openings 50, 52 may extend at least partially through the hood portions 46, 48 such that the openings 50, 52 open to the slots 44.

Figure 3:
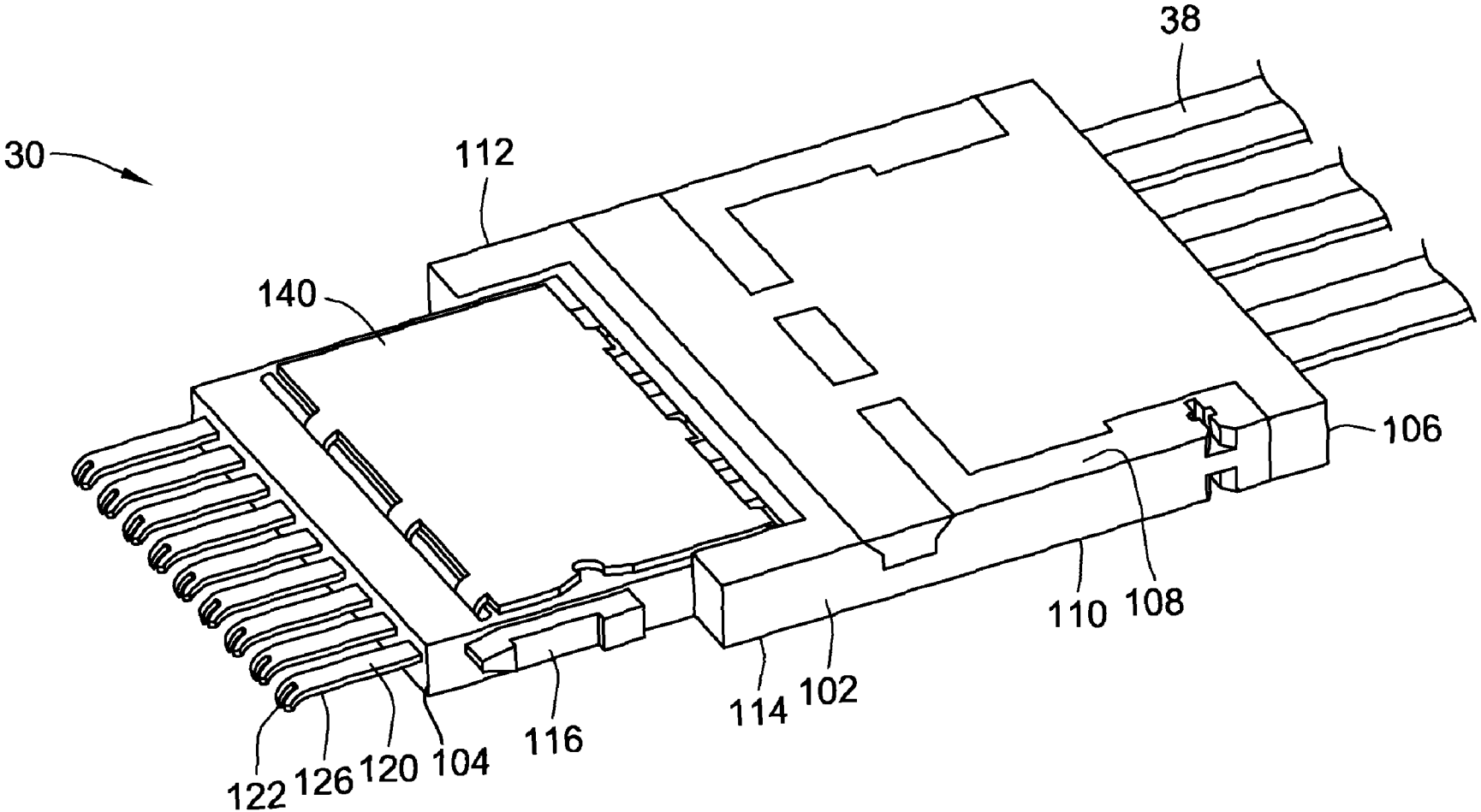
FIG. 3 is a perspective view of a contact module that is matable with the housing shown in FIG. 2 to form the cable connector.
Figure 4:
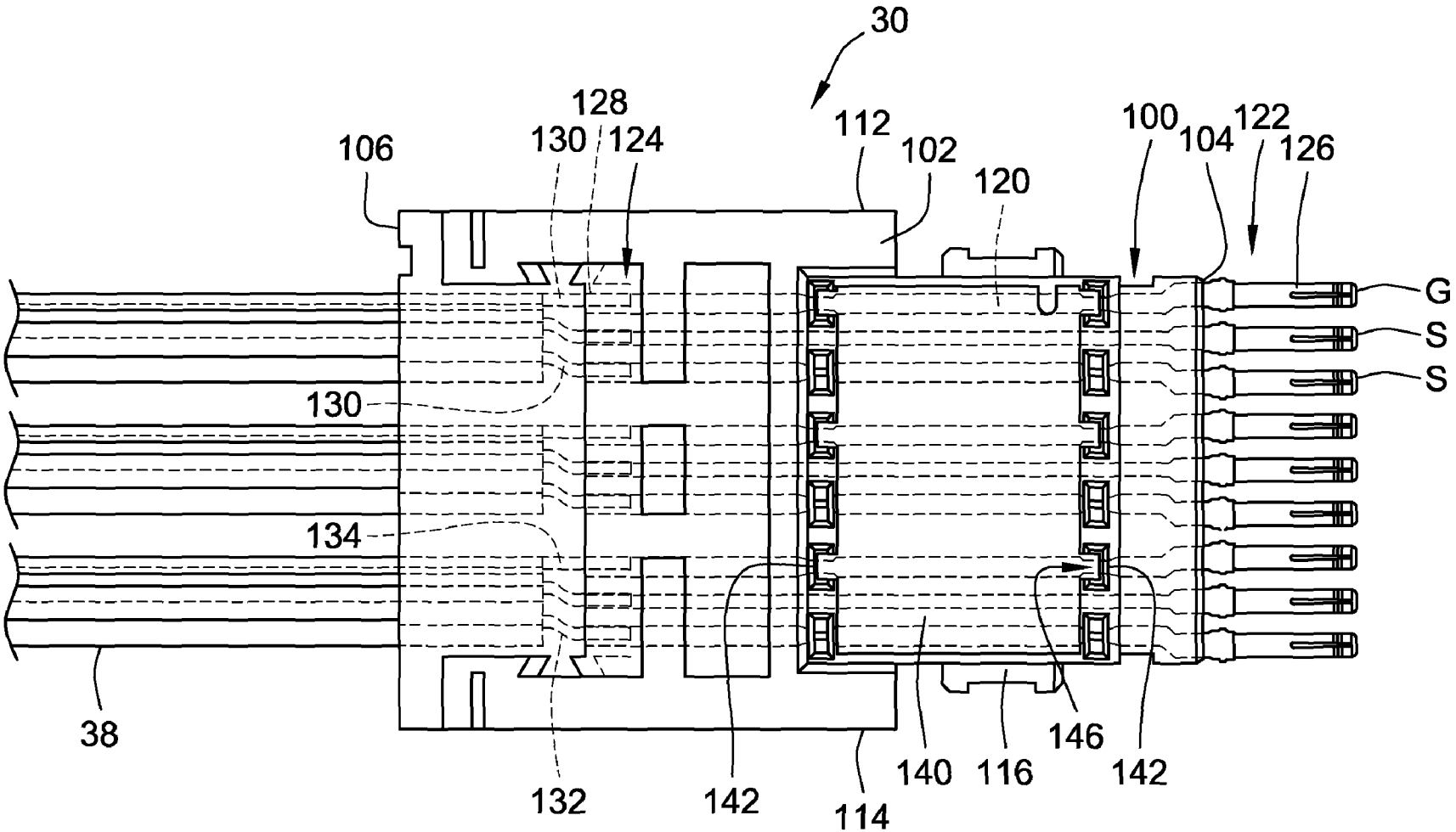
FIG. 4 schematically illustrates an internal structure, including a leadframe, of the contact module shown in FIG. 3.

FIG. 3 is a perspective view of one of the contact modules 30 that is matable with the housing 12 (shown in FIG. 2) to form the cable connector 6 (shown in FIG. 1). FIG. 4 illustrates an internal structure, including an internal lead frame 100, of the contact module 30 in phantom. The contact module 30 includes a dielectric body 102 that surrounds the lead frame 100. In some embodiments, the body 102 is manufactured using an overmolding process. During the overmolding process, the lead frame 100 is encased in a dielectric material, such as a plastic material, which forms the body 102. Optionally, the contact module 30 may be manufactured in stages that include more than one overmolding processes (e.g. an initial overmolding and a final overmolding). The body 102 may be manufactured using other forming processes other than overmolding. For example, rather than being overmolded, the body may be manufactured in one or more components that are coupled together around the lead frame 100 or that receive individual contacts rather than a lead frame 100.

As illustrated in FIG. 3, the body 102 extends between a forward mating end 104 and a rear end 106. The cables 38 extend rearward from the rear end 106. The body 102 includes opposed first and second generally planar side surfaces 108 and 110, respectively. The side surfaces 108 and 110 extend substantially parallel to and along the lead frame 100. The body 102 includes opposed top and bottom ends 112, 114. Optionally, ribs 116 may be provided on each of the top and bottom ends 112, 114. The ribs 116 may be used to guide and/or orient the contact modules 30 into or within the slots 44 and/or chambers 42 of the housing 12 (shown in FIG. 2).

As illustrated in FIG. 4, the lead frame 100 includes a plurality of contacts 120 that extend between mating ends 122 and wire terminating ends 124. Mating contact portions 126 are provided at the mating ends 122, and the mating contact portions 126 are loaded into the contact cavities 18 (shown in FIG. 1) of the housing 12 for mating with corresponding mating contacts of the header connector assembly (not shown). The contacts 120 define wire mating portions proximate to the wire terminating ends 124. For example, the contacts 120 may include solder pads 128 at the wire terminating ends 124 for terminating to respective wires 130 of the cable 38 by soldering. Other terminating processes and/or features may be provided at the wire terminating ends 124 for terminating the wires 130 to the contacts 120. For example, insulation displacement contacts, wire crimp contacts, and the like may be provided at the wire terminating ends 124. The mating contact portions 126 and/or the solder pads 128 may be formed integrally with the contacts 120, such as by a stamping and/or forming process, or the mating contact portions 126 and/or the solder pads 128 may be separately provided and electrically connected to the contacts 120.

In an exemplary embodiment, the contacts 120 are arranged generally parallel to one another between the mating ends 122 and wire terminating ends 124, and the mating ends 122 and the wire terminating ends 124 are provided at generally opposite ends of the contact module 30. However, other configurations of contacts 120 may be provided in alternative embodiments, such that the contacts 120 and/or at least one of the mating and/or wire terminating ends 122, 124 have different arrangements or positions.

The contacts 120 are grouped together and arranged in a predetermined pattern of signal, ground and/or power contacts. In the illustrated embodiment, the contacts 120 are arranged in groups of three contacts 120 that have two signal contacts carrying differential signals and one ground contact. The group of contacts 120 are adapted for connection with cables 38 having two differential signal wires 132 and a ground wire 134. In one embodiment, as illustrated in FIG. 4, the pattern of contacts 120 is a ground-signal-signal pattern (from the top end 112 to the bottom end 114 of the body 102). As such, a ground contact is arranged between each adjacent pair of signal contacts. In another embodiment, the pattern of contacts 120 is a signal-signal-ground pattern (from the top end 112 to the bottom end 114 of the body 102). As such, a ground contact is arranged between each adjacent pair of signal contacts.

In an exemplary embodiment, the lead frame 100 and body 102 are universal, such that the pattern of contacts 120 may be established by the coupling of the signal or ground wires 132, 134 to the contacts 120. For example, if the ground wire 134 is terminated to the top-most contact 120 of each grouping, then the contact module 30 will have a ground-signal-signal pattern, whereas, if the ground wire 134 is terminated to the bottom-most contact 120 of each grouping, then the contact module 30 will have a signal-signal-ground pattern. As such, the same contact modules 30 may be mated within the housing 12, but the patterns of the contacts 120 of different ones of the contact modules 30 within the housing 12 may be different. For example, adjacent ones of the contact modules 30 within the housing 12 may have different patterns of contacts 120.

In an exemplary embodiment, the contact module 30 may include a commoning member 140, similar to the commoning member described in U.S. patent application Ser. No. 11/969,716 filed Jan. 4, 2008, titled CABLE CONNECTOR ASSEMBLY, the complete disclosure of which is herein incorporated by reference in its entirety. The commoning member 140 may be used to define which of the contacts 120 of the lead frame 100 define ground contacts. When connected, the commoning member 140 interconnects and electrically commons each of the ground contacts to which the commoning member 140 is connected. For example, the commoning member 140 may be mechanically and electrically connected to each of the ground contacts within the lead frame 100. In an exemplary embodiment, certain ones of the contacts 120 may include grounding portions 142 to which the commoning member 140 is connected. Optionally, the commoning member 140 may connect to the ground contacts at multiple points along each ground contact, such as proximate to the mating end 122 and the wire terminating end 124 thereof. In an exemplary embodiment, the orientation of the commoning member 140 with respect to the body 102 may define the contact pattern (e.g. ground-signal-signal versus signal-signal-ground).

Figure 5:
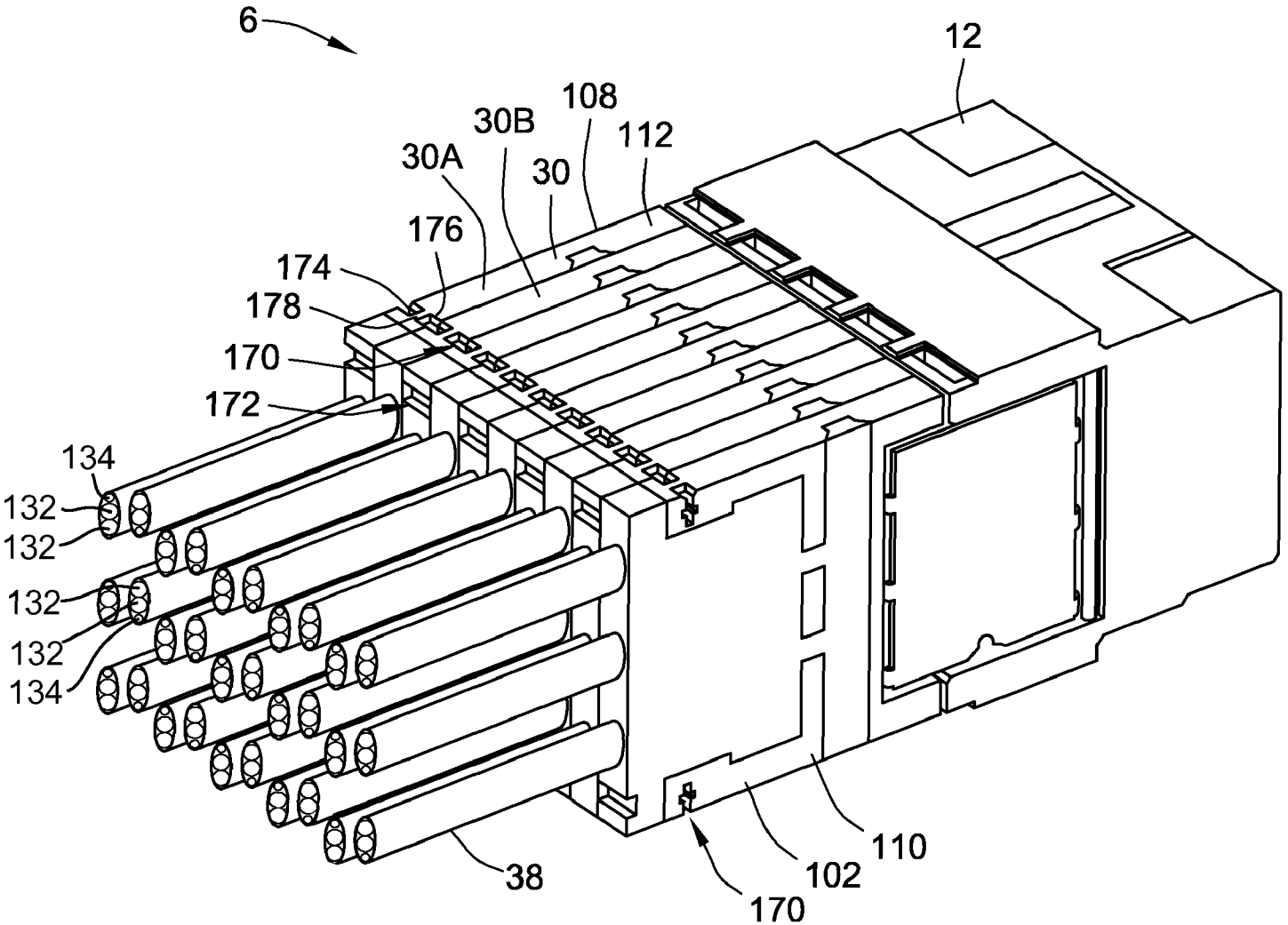
FIG. 5 is a rear perspective view of the cable connector.

FIG. 5 is a rear perspective view of the cable connector 6 in a partially assembled state. The contact modules 30 are plugged into the chambers 42 (shown in FIG. 2) of the housing 12. Optionally, the contact modules 30 may be resiliently retained within the chambers 42, such as by a friction fit and/or with barbs on the contact portions 126 (shown in FIG. 4). In the illustrated embodiment, the contact modules 30 are arranged within the housing 12 such that adjacent ones of the contact modules 30 have different patterns of contacts 120 (shown in FIG. 4). For example, some of the contact modules 30A have contacts arranged with a first pattern of contacts arranged as ground-signal-signal (when viewed from the top end 112) and others of the contact modules 30B have contacts arranged with a second pattern of contacts arranged as signal-signal-ground (when viewed from the top end 112). In an exemplary embodiment, the contact modules 30A and 30B are substantially identically formed, but the connection of the wires and/or the orientation of the commoning member 140 may determine the pattern of the contacts.

Additionally, as illustrated in FIG. 5, the cables 38 associated with the contact modules 30A having the first pattern each include the ground wires 134 on the top of the pair of signal wires 132, whereas the cables 38 associated with the contact modules 30B having the second pattern each include the ground wires 134 on the bottom of the pair of signal wires 132. A notch 172 may be provided on the body 102 of each contact module 30, wherein the notch 172 provides a visual indication of the type of contact module 30 when plugged into the housing 12. For example, the contact modules 30A having the first pattern each provide the notch 172 proximate to the top end 112, whereas the contact modules 30B having the second pattern each provide the notch 172 proximate to the bottom end 112.

In an exemplary embodiment, grooves 170 are provided in the bodies 102 of the contact modules 30 for receiving portions of the upper and lower shells 34, 36 (shown in FIG. 1). In an exemplary embodiment, a first groove 174 extends inwardly from each first side surface 108 of each body 102, and a second groove 176 extends inwardly from each second side surface 110 of each body 102. The body forms a web 178 between each of the first and second grooves 174, 176. When the contact modules 30 are arranged within the housing 12, the grooves 174, 176 of adjacent contact modules 30 are aligned with one another, such that a first groove 174 of one contact module 30 opens to a second groove 176 of an adjacent contact module 30. The upper and lower shells 34, 36 may thus engage more than one contact module 30 when assembled, which may hold adjacent ones of the contact modules 30 substantially in place relative to one another. The upper and lower shells 34, 36 may prevent adjacent contact modules 30 from spreading apart from one another, in essence locking each of the contact modules 30 together, to provide rigidity to the contact modules 30.

Figure 6:
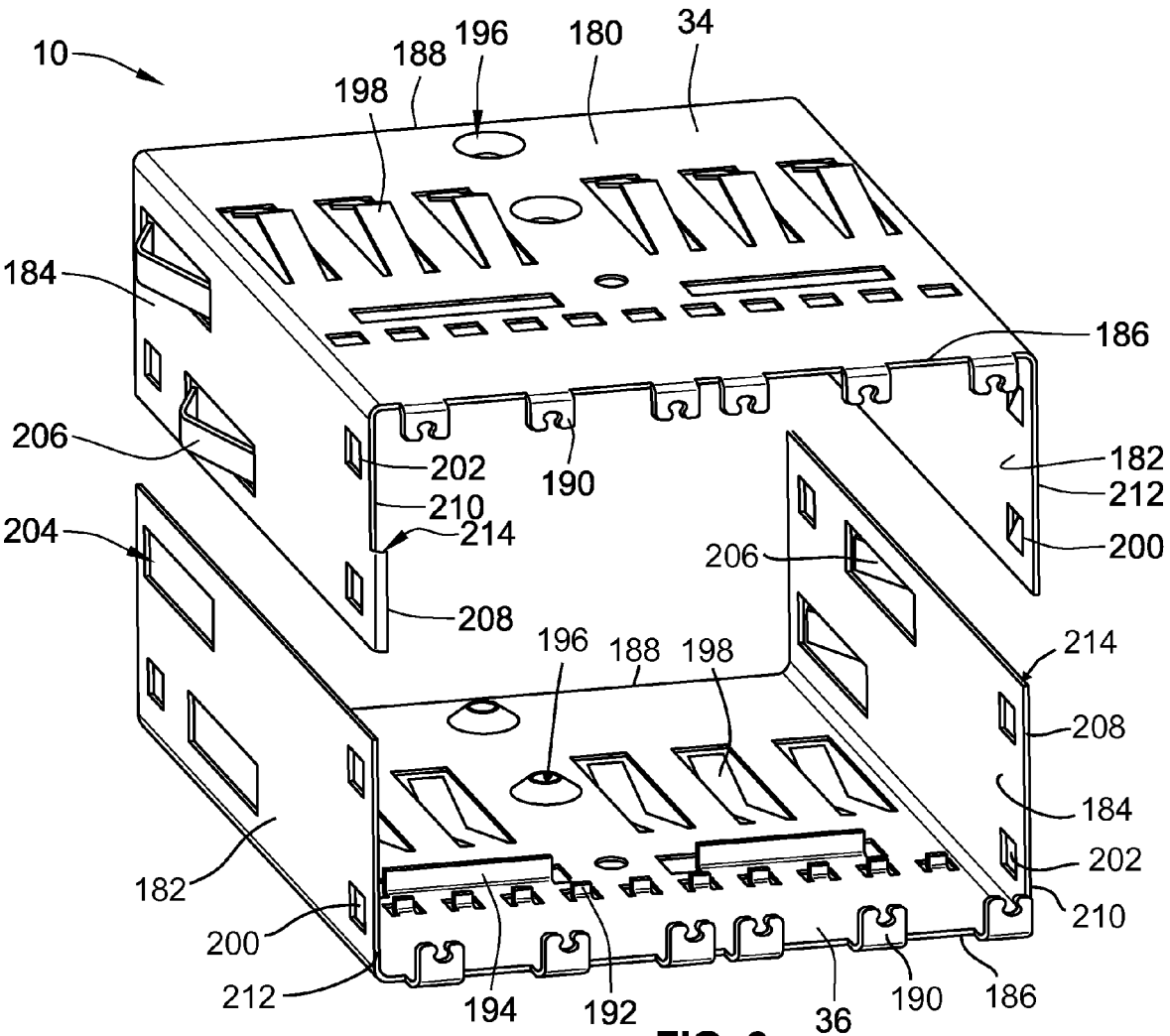
FIG. 6 illustrates a back shell formed in accordance with an exemplary embodiment and usable with the receptacle connector assembly shown in FIG. 1.

FIG. 6 illustrates the upper and lower shells 34, 36 formed in accordance with an exemplary embodiment and usable with the receptacle connector assembly 4 (shown in FIG. 1). The upper and lower shells 34, 36 may be substantially identically formed and inverted with respect to one another when assembled. Because the upper and lower shells 34, 36 are substantially identical, only the upper shell 34 will be described in detail. However, the lower shell 36 may include some or all of the features of the upper shell 34, and like features of the lower shell 36 may be identified with like reference numerals. In alternative embodiments, the upper and lower shells 34, 36 may be formed differently and include different features, but still entirely peripherally surround the cable connectors 6 (shown in FIG. 1).

The upper shell 34 includes an end wall 180 and opposite side walls 182, 184 extending from the end wall 180. In an exemplary embodiment, the upper shell 34 is stamped and formed from a blank of metal material to form the end wall 180 and side walls 182, 184. As such, the side walls 182, 184 are integrally formed with the end wall 180. Because the upper shell 34 is manufactured from metal, the upper shell 34 provides shielding for the cable connectors 6 and the cable exit plate 8. For example, the upper shell 34 may provide shielding from EMI.

In an exemplary embodiment, the end wall 180 and side walls 182, 184 are generally planar, with the side walls 182, 184 extending perpendicular to the end wall 180. The side walls 182, 184 are parallel to one another and arranged at opposite sides of the end wall 180. The upper shell 34 may have different configurations in alternative embodiments. For example, the side walls 182, 184 may be non-planar. Each side wall 182, 184 may include multiple wall segments that are angled with respect to one another, or the side walls 182, 184 may be curved. The side walls 182, 184 may be non-perpendicular to the end wall 180. Optionally, the upper shell 34 may only include one side wall 182 or 184 such that the upper shell 34 has an L-shape. Alternatively, the side walls 182, 184 may have different heights with one side wall 182 or 184 extending further from the end wall 180 than the other side wall 182, or 184. As such, the upper shell 34 may have a J-shape.

The end wall 180 extends axially between a front end 186 and a rear end 188. The end wall 180 includes housing tabs 190 extending inward therefrom. The housing tabs 190 are configured to be received in the openings 50, 52 (shown in FIG. 1) of the housing 12 (shown in FIG. 1) to secure the back shell 10 to the housing 12. In the illustrated embodiment, the housing tabs 190 represent a clip having an open bottom that receives a portion of the housing 12 therein when the upper shell 34 is coupled to the housing 12. The housing tabs 190 may be received in the openings 50, 52 by a friction fit to secure the upper shell 34 to the housing 12.

The end wall 180 includes contact module tabs 192 (shown on the lower shell 36) extending inward therefrom. The contact module tabs 192 are configured to be received in corresponding grooves 170 (shown in FIG. 5) of the contact modules 30 (shown in FIG. 5) to secure the back shell 10 to the contact modules 30. In the illustrated embodiment, the contact module tabs 192 have a flared end that is bulbous in shape. The flared end may be received in the grooves 170 by a friction fit to secure the upper shell 34 to the contact modules 30. In an exemplary embodiment, the contact module tabs 192 are installed in the aligned grooves 170 between two adjacent contact modules 30 such that the contact module tabs 192 engage both of the contact modules 30. For example, the contact module tabs 192 may be simultaneously received within the first groove 174 (shown in FIG. 5) of one contact module 30 and within the second groove 176 (shown in FIG. 5) of an adjacent contact module 30.

The end wall 180 includes one or more wings 194 (shown on the lower shell 36) extending inward therefrom. The wings 194 are configured to engage the rear end 106 (shown in FIGS. 3 and 4) of the contact modules 30 when the back shell 10 is coupled to the contact modules 30. The wings 194 are configured to block rearward movement of the contact modules 30 with respect to the housing 12 by functioning as a rearward stop for the contact modules 30. As such, the wings 194 provide strain relief for the contact modules 30.

The rear portion of the end wall 180, generally rearward of the wings 194, is configured to extend along the cable exit plate 8. The end wall 180 covers the cable exit plate 8 and provides shielding for the cable exit plate 8. Openings 196 extend through the end wall 180 that receive fasteners (not shown) for securely coupling the upper shell 34 to the cable exit plate 8. The openings 196 may additionally or alternatively receive fasteners from polarizing features. For example, a polarizing feature may be mounted to an external surface of the upper shell 34 and/or the lower shell 36.

The end wall 180 includes a plurality of EMI fingers 198. In the illustrated embodiment, the EMI fingers 198 extend axially along the rear portion of the end wall 180. The EMI fingers 198 are generally configured to be positioned rearward of the contact modules 30 and are to be aligned with the cable exit plate 8. The EMI fingers 198 are non-planar with the end wall 180. In the illustrated embodiment, the EMI fingers 198 are cantilevered from the end wall 180 and are initially angled outward and then angled back inward. In an exemplary embodiment, the EMI fingers 198 engage a panel or chassis that is positioned in the vicinity of the receptacle connector assembly 4. The EMI fingers are resilient and are capable of being deflected to maintain a biasing force against the chassis.

The side walls 182, 184 are formed differently than one another, however the side walls 182, 184 may be identical to one another in alternative embodiments. The side wall 182 includes latching features 200 in the form of tines that are cantilevered outward, and the side wall 184 includes latching features 202 in the form of windows that receive the tines. The latching features 200, 202 interact with one another to latch or otherwise couple the upper shell 34 and the lower shell 36 together. The latching features 200, 202 physically engage one another when the upper shell 34 and the lower shell 36 are coupled together. The side walls 182, 184 may have different types of latching features 200, 202 in alternative embodiments. When the latching features 200, 202 are coupled, the latching features 200, 202 prevent forward and rearward axial movement, as well as upward and downward movement of the upper shell 34 with respect to the lower shell 36, and vice versa. In the illustrated embodiment, the latching features 200, 204 are provided at both a front and a rear of the side walls 182, 184.

The side wall 182 includes openings 204 and the side wall 184 includes EMI fingers 206 that are aligned with the openings 204. The EMI fingers 206 may be forced through the openings 204, such as when the EMI fingers 206 engage a chassis.

The side wall 184 includes a rail 208 extending forward of a front edge 210 of the side wall 184. The rail 208 is configured to engage a front edge 212 of the side wall 182. In an exemplary embodiment, the rail 208 represents a hook that wraps around approximately 180°. The rail 208 includes a channel 214 that receives the front edge 212 of the side wall 182 when the upper shell 34 and lower shell 36 are coupled together. The channel 214 is open at the rear of the channel 214 for receiving the side wall 182. As such, the channel 214 and rail 208 represent a female component and the front edge 212 of the side wall 182 represents a male component. The male component is received in the female component when the upper shell 34 and the lower shell 36 are coupled together. Because both the upper shell 34 and the lower shell 36 include such rails 208, the rails 208 prevent forward axial movement of the upper shell 34 with respect to the lower shell 36, and vice versa. Because both the upper and lower shells 34, 36 include the rails 208 on the side wall 184 and the front edge 210 on the other side wall 182, the upper and lower shells 34, 36 are hermaphroditic including both male and female components that are mated together.

In the illustrated embodiment, the side walls 182, 184 have similar heights so that the side walls 182, 184 extend from the end wall 180 for approximately the same amount. When the upper shell 34 and the lower shell 36 are coupled together, the side walls 182, 184 at least partially overlap. The side walls 182 of the upper and lower shells 34, 36 may be positioned inside of the side walls 184 of the upper and lower shells 34, 36.

Figure 7:
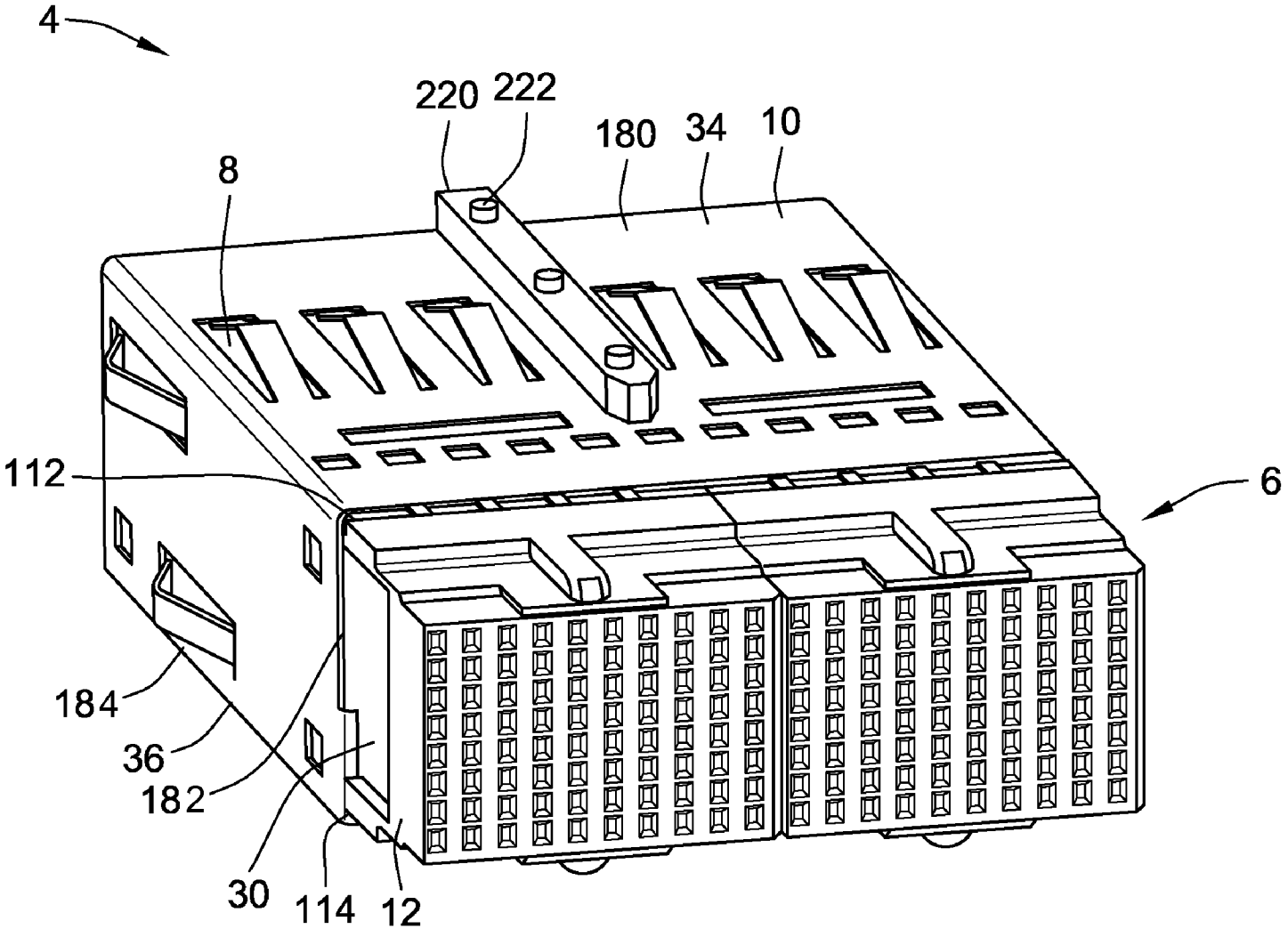
FIG. 7 illustrates the receptacle connector assembly in an assembled state.

FIG. 7 illustrates the receptacle connector assembly 4 in an assembled state. The back shell 10 surrounds the cable connectors 6 and the cable exit plate 8 to provide shielding around the cable connectors 6 and the cable exit plate 8. In the illustrated embodiment, the back shell 10 surrounds the cable connectors 6 rearward of the housings 12. The back shell 10 extends along portions of the contact modules 30 and provides shielding for the contact modules 30. In an alternative embodiment, the back shell 10 may cover a portion of the housings 12.

The cable connectors 6 are arranged side-by-side such that the housings 12 abut, or almost abut, one another. The back shell 10 is positioned such that the end walls 180 of the upper and lower shells 34, 36 extend along the top and bottom ends 112, 114 (shown in FIG. 3), respectively, of the contact modules 30. The end walls 180 also extend along a top and bottom of the cable exit plate 8. The side walls 182, 184 of the upper and lower shells 34, 36 extend along one of the side surfaces 108, 110 of one of the cable connectors 6. The side walls 182, 184 also extend along the sides of the cable exit plate 8. As such, the back shell 10 entirely surrounds the periphery of the cable connectors 6 and cable exit plate 8.

In the illustrated embodiment, a polarizing feature 220 is mounted to the end wall 180 of the upper shell 34. The polarizing feature 220 orients the receptacle connector assembly 4 within the electronic device in which the receptacle connector assembly 4 is mounted. For example, the receptacle connector assembly 4 may be mounted within a computer or a network component. The polarizing feature 220 engages a corresponding feature of the electronic device to properly position the receptacle connector assembly 4. The polarizing feature 220 is secured to the back shell 10 using fasteners 222. The fasteners 222 are coupled to the openings 196 (shown in FIG. 6). Optionally, the fasteners 222 may also be coupled to the cable exit plate 8 through the openings 196.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing having a front and a rear, the housing having openings in an outer periphery of the housing;

contact modules received in the housing through the rear, the contact modules extending from the rear of the housing, the contact modules having grooves in an outer periphery of the contact modules; and a back shell coupled to the housing and the contact modules, the back shell having housing tabs extending therefrom and being received in the openings of the housing to secure the back shell to the housing, the back shell having contact module tabs extending therefrom and being received in corresponding grooves of the contact modules to secure the back shell to the contact modules, the back shell peripherally surrounding the contact modules.

2. The assembly of claim 1, wherein the back shell has an upper shell and a lower shell separate and distinct from the upper shell, the upper shell and the lower shell being substantially identical to one another, the upper shell and the lower shell being coupled to one another.

3. The assembly of claim 1, wherein the back shell has two hermaphroditic shell halves coupled to one another, the shell halves each being coupled to the housing and contact modules.

4. The assembly of claim 1, wherein the connector assembly comprises multiple housings arranged in a stacked configuration, each of the housings receiving a plurality of the contact modules, the back shell being coupled to the multiple housings to hold the multiple housings together as a single connector assembly.

5. The assembly of claim 1, wherein the back shell is metal and provides shielding around the entire periphery of the contact modules.

6. The assembly of claim 1, wherein the back shell has an end wall and a side wall, the end wall engaging each of the contact modules, the side wall engaging one of the contact modules.

7. The assembly of claim 1, wherein the back shell includes an upper shell and a lower shell, the upper shell and the lower shell both having an end wall and opposite side walls extending from the end wall, the side walls each including latching features, the latching features of the upper shell cooperating with the latching features of the lower shell to secure the upper shell and the lower shell together.

8. The assembly of claim 1, wherein the back shell includes an upper shell and a lower shell, the upper shell and the lower shell both having an end wall and opposite side walls extending from the end wall, at least one of the side walls of the lower shell includes a rail configured to engage a corresponding side wall of the upper shell, the rail preventing axial movement of the upper shell with respect to the lower shell.

9. The assembly of claim 1, wherein the back shell extends rearward of the contact modules to create a cable chamber rearward of the contact modules, the cable connector assembly further comprising cables extending rearward from the contact modules, the back shell providing shielding around the cables in the cable chamber.

10. The assembly of claim 1, further comprising a cable exit plate rearward of the contact modules, the cable exit plate securely holding cables extending from contact modules, the back shell peripherally surrounding the cable exit plate.

11. The assembly of claim 1, further comprising a cable exit plate rearward of the contact modules, the cable exit plate securely holding cables extending from the contact modules, the back shell being secured to the cable exit plate by fasteners.

12. The assembly of claim 1, wherein the housing tabs are press fit into the openings, the contact module tabs being press fit into the at least one groove.

13. The assembly of claim 1, wherein the contact modules each include contacts configured to engage mating contacts of a mating connector, the contact modules having a dielectric body encasing the contacts, the contact module having cables terminated to corresponding contacts and extending from the dielectric body.

14. The assembly of claim 1, wherein the back shell has EMI fingers positioned rearward of the contact modules, the back shell providing shielding rearward of the contact modules.

15. The assembly of claim 1, wherein the back shell includes a wing extending inward therefrom, the wing engaging a rear of a plurality of the contact modules, the wing blocking rearward movement of the contact modules with respect to the housing.

16. A connector assembly comprising:

a connector having a connector housing having openings in an outer periphery of the housing and contact modules received in the housing, the contact modules extending rearward from the housing, the contact modules having a dielectric body encasing multiple contacts, the contacts being configured to be terminated to cables extending rearward from the dielectric body, the dielectric bodies of the contact modules having grooves in an outer periphery of the contact modules; and a metal back shell coupled to the connector and providing shielding around the connector, the back shell having an upper shell and a lower shell separate and distinct from one another, the upper shell and the lower shell being coupled to one another to peripherally surround the connector, the back shell being coupled to the housing and to the contact modules to maintain the relative positions of the contact modules with respect to the housing.

17. The assembly of claim 16, wherein the upper shell and the lower shell both including housing tabs extending therefrom being received in the openings of the housing to secure the back shell to the housing, the upper shell and the lower shell both including contact module tabs extending therefrom being received in corresponding grooves of the contact modules to secure the back shell to the contact modules.

18. The assembly of claim 16, wherein the upper shell and the lower shell are substantially identical to one another, the lower shell being inverted with respect to the upper shell and coupled thereto.

19. The assembly of claim 16, wherein the connector assembly comprises multiple connectors arranged in a stacked configuration, the back shell being coupled to the multiple connectors to hold the multiple connectors together as a single connector assembly.

20. The assembly of claim 16, wherein the upper shell and the lower shell both have an end wall and opposite side walls extending from the end wall, at least one of the side walls of the lower shell includes a rail configured to engage a corresponding side wall of the upper shell, the rail preventing axial movement of the upper shell with respect to the lower shell.

* * * * *